US012606985B2

(12) United States Patent
Rausch et al.

(10) Patent No.: US 12,606,985 B2
(45) Date of Patent: Apr. 21, 2026

(54) COLLISION AVOIDANCE SYSTEM FOR AVOIDING COLLISION BETWEEN MOVABLE COMPONENTS AND PORTIONS OF A WORK MACHINE

(71) Applicant: Deere & Company, Moline, IL (US)

(72) Inventors: Bryan J. Rausch, Durango, IA (US); Jeffery W. Dobchuk, Saskatoon (CA); Justin Sticksel, Galena, IL (US)

(73) Assignee: Deere & Company, Moline, IL (US)

( * ) Notice: Subject to any disclaimer, the term of this patent is extended or adjusted under 35 U.S.C. 154(b) by 153 days.

(21) Appl. No.: 18/364,214

(22) Filed: Aug. 2, 2023

(65) Prior Publication Data

US 2025/0043540 A1 Feb. 6, 2025

(51) Int. Cl.
*E02F 9/20* (2006.01)

(52) U.S. Cl.
CPC ..... *E02F 9/2033* (2013.01); *E02F 9/2029* (2013.01)

(58) Field of Classification Search
CPC ..... E02F 9/2033; E02F 9/2029; E02F 9/205; E02F 9/262; E02F 9/265
See application file for complete search history.

(56) References Cited

U.S. PATENT DOCUMENTS 5,957,989 A * 9/1999 Egawa ..... E02F 9/2033 701/50
6,064,918 A * 5/2000 Ohtsukasa ..... E02F 9/2033 700/86
10,801,180 B2 10/2020 Sherlock
2004/0237353 A1 12/2004 Okunishi et al.
2010/0170118 A1 7/2010 Thomas
2019/0249391 A1 8/2019 Kikuchi et al.
2019/0330823 A1* 10/2019 Kean ..... F15B 21/087
2019/0376260 A1* 12/2019 Sherlock ..... E02F 3/435
2020/0024829 A1 1/2020 Fiser et al.
2020/0232180 A1 7/2020 Takebayashi et al.
2020/0340206 A1 10/2020 Mori et al.
2021/0207339 A1 7/2021 Nakatani et al.
2021/0332560 A1 10/2021 Takebayashi et al.
2022/0298744 A1 9/2022 Horii
(Continued)

FOREIGN PATENT DOCUMENTS

DE 69612271 T2 7/2001
DE 69831713 T2 5/2006
(Continued)

OTHER PUBLICATIONS

German Search Report issued in application No. 102024118761.1 dated Feb. 6, 2025, 12 pages.
(Continued)

*Primary Examiner* — Kyle J Kingsland
(74) *Attorney, Agent, or Firm* — Christopher J. Volkmann; KELLY, HOLT & CHRISTENSON PLLC

(57) ABSTRACT

A work machine identifies a commanded trajectory of a point-of-interest on a movable element. An analysis system determines whether a protected part of the work machine is along the trajectory of the point-of-interest and, if so, identifies an actuator that moves the point-of-interest along the commanded trajectory. A control signal is generated to selectively control the identified actuator to avoid contact between the point-of-interest and the protected part of the work machine.

19 Claims, 9 Drawing Sheets

(56) References Cited

U.S. PATENT DOCUMENTS

| | | | | |
|---|---|---|---|---|
| 2023/0084302 | A1 | 3/2023 | Okazaki | |
| 2023/0407601 | A1 | 12/2023 | Lee et al. | |
| 2024/0093463 | A1 | 3/2024 | Sakisaka et al. | |
| 2025/0026622 | A1* | 1/2025 | Iotti | B66F 9/22 |

FOREIGN PATENT DOCUMENTS

| | | | |
|---|---|---|---|
| DE | 102019206515 | A1 | 12/2019 |
| EP | 3409841 | A1 | 12/2018 |
| EP | 3744903 | A1 | 12/2020 |
| GN | 104420494 | B | 5/2018 |
| JP | 2005248502 | A | 9/2005 |
| JP | 2018178502 | A | 11/2018 |
| KR | 20150027451 | A | 3/2015 |

OTHER PUBLICATIONS

Search Report for German Application No. 102024118692.5, dated Feb. 17, 2025, 12 Pages.

* cited by examiner

COLLISION AVOIDANCE SYSTEM FOR AVOIDING COLLISION BETWEEN MOVABLE COMPONENTS AND PORTIONS OF A WORK MACHINE

FIELD OF THE DESCRIPTION

The present description generally relates to the use of equipment in worksite operations. More specifically, the present description relates to controlling and protecting the equipment from colliding with itself.

BACKGROUND

There is a wide variety of different types of equipment such as forestry equipment, construction equipment, among others. These types of equipment are often operated by an operator and have sensors that generate information during an operation.

Further, many different types of equipment can be equipped to use a variety of attachments. For example, excavators have many options for attachments. Some of these include buckets, grapples, augers, trench diggers, etc.

The discussion above is merely provided for general background information and is not intended to be used as an aid in determining the scope of the claimed subject matter.

SUMMARY

A work machine identifies a commanded trajectory of a point-of-interest on a movable element. An analysis system determines whether a protected part of the work machine is along the trajectory of the point-of-interest and, if so, identifies an actuator that moves the point-of-interest along the commanded trajectory. A control signal is generated to selectively control the identified actuator to avoid contact between the point-of-interest and the protected part of the work machine.

Example 1 is a method of controlling a work machine, comprising:

accessing a geometric construct corresponding to a protected portion of the work machine;

locating a point-of-interest on a movable element of the work machine relative to the geometric construct;

receiving a command to move the point-of-interest along a trajectory of action;

determining that the trajectory-of-action intersects with the geometric construct;

identifying an actuator driving the movement of the point-of-interest along the trajectory-of-action;

selectively limiting movement of the identified actuator to inhibit contact between the movable element and the protected portion of the work machine.

Example 2 is the method of any or all previous examples wherein identifying an actuator comprises:

identifying a subset of actuators, that drive movement of the movable element, that can be limited to avoid contact between the point-of-interest and the protected portion of the work machine.

Example 3 is the method of any or all previous examples wherein identifying an actuator comprises:

accessing machine kinematic information indicative of actuator actuations that move the movable element; and identifying the actuator based on the machine kinematic information.

Example 4 is the method of any or all previous examples wherein identifying the actuator comprises:

identifying a plurality of actuators driving movement of the point-of-interest along the trajectory-of-action.

Example 5 is the method of any or all previous examples wherein selectively limiting movement of the identified actuator comprises:

selectively limiting movement of the plurality of actuators to inhibit contact between the movable element and the protected portion of the work machine.

Example 6 is the method of any or all previous examples and further comprising:

accessing a set of vertices corresponding to the protected portion of the work machine; and generating the geometric construct based on the set of vertices.

Example 7 is the method of any or all previous examples wherein accessing a set of vertices comprises:

accessing the set of vertices from a solid model of the protected portion of the work machine.

Example 8 is the method of any or all previous examples wherein accessing the set of vertices comprises:

downloading the set of vertices from a remote server.

Example 9 is the method of any or all previous examples wherein determining that the trajectory-of-action intersects with the geometric construct comprises:

locating the geometric construct in a coordinate system local to the work machine;

locating the trajectory-of-action in the coordinate system local to the work machine; and comparing the location of the geometric construct to the location of the trajectory-of-action to identify intersection of the trajectory-of-action with the geometric construct.

Example 10 is the method of any or all previous examples and further comprising:

identifying a distance of the point-of-interest from the protected portion of the work machine; and identifying a speed with which the point-of-interest approaches the protected portion of the work machine based on the command.

Example 11 is the method of any or all previous examples wherein selectively limiting movement of the identified actuator comprises:

selectively limiting movement of the identified actuator based on the distance and the speed with which the point-of-interest approaches the protected portion of the work machine.

Example 12 is the method of any or all previous examples wherein selectively limiting movement of the identified actuator to inhibit contact between the movable element and the protected portion of the work machine comprises:

selectively limiting movement of the identified actuator to limit movement of the point-of-interest to maintain a threshold separation distance between the point-of-interest and the protected portion of the work machine.

Example 13 is a work machine, comprising:

a frame supporting a protected portion of the work machine;

a plurality of movable elements mounted to the frame;

a plurality of actuators configured to drive movement of the movable elements relative to the frame;

a geometric construct position detector configured to identify a geometric construct corresponding to the protected portion of the work machine;

a point-of-interest location system configured to locate a point-of-interest on a movable element of the work machine relative to the geometric construct;

an input command processor configured to receive a command to move the point-of-interest along a trajectory-of-action and determine that the trajectory-of-action intersects with the geometric construct;

an actuator identification system configured to identify an actuator, of the plurality of actuators, driving the movement of the point-of-interest along the trajectory-of-action;

a selective limit identification processor configured to generate a limitation signal; and an actuator controller configured to selectively limit movement of the identified actuator, based on the limitation signal, to inhibit contact between the movable element and the protected portion of the work machine.

Example 14 is the work machine of any or all previous examples wherein the actuator identification system is configured to identify a subset of actuators, that drive movement of the movable element along the trajectory-of-action, that can be limited to avoid contact between the point-of-interest and the protected portion of the work machine.

Example 15 is the work machine of any or all previous examples wherein the actuator identification system is configured to identify, as the subset of actuators, a plurality of actuators driving movement of the point-of-interest along the trajectory-of-action and wherein the selective limit identification processor is configured to identify a generate a plurality of limitation signals corresponding to the identified plurality of actuators.

Example 16 is the work machine of any or all previous examples wherein the actuator controller is configured to selectively limiting movement of the identified plurality of actuators to inhibit contact between the movable element and the protected portion of the work machine.

Example 17 is the work machine of any or all previous examples and further comprising:

a geometric construct identification system configured to access a set of vertices corresponding to the protected portion of the work machine and generate the geometric construct based on the set of vertices.

Example 18 is the work machine of any or all previous examples wherein the input command processing system comprises:

a trajectory-of-action identification system configured to locate the trajectory-of-action in a coordinate system local to the work machine;

a geometric construct position detector configured to locate the geometric construct in the coordinate system local to the work machine; and an intersection detection processor configured to compare the location of the geometric construct to the location of the trajectory-of-action to identify intersection of the trajectory-of-action with the geometric construct.

Example 19 is a collision avoidance system, comprising:

a position detector configured to identify a geometric construct corresponding to a protected portion of a work machine;

a location system configured to locate a movable element of the work machine relative to the geometric construct;

a command processor configured to receive an input to move the movable element along a trajectory and determine whether the trajectory intersects with the geometric construct;

an actuator identifier configured to identify an actuator on the work machine that drives movement of the movable element along the trajectory; and a selective limit processor configured to generate a limitation signal and provide the limitation signal to a controller to selectively limit movement of the identified actuator.

Example 20 is the collision avoidance system of any or all previous examples wherein the work machine has a plurality of actuators that are configured to drive movement of the movable element and wherein the actuator identifier is configured to identify a subset of the plurality of actuators that can be limited to avoid contact between the movable element and the protected portion of the work machine.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the background.

DETAILED DESCRIPTION

Many types of machinery are becoming more modular, meaning that they are able to perform a variety of different functions by replacing a controllable attachment. For example, excavators traditionally have a bucket as an attachment. However, today there are many different kinds of buckets and many different attachments that can replace the bucket, such as a grapple, an auger, a compaction wheel, a backfill blade, a concrete crusher, a slope packer, a trench digger, etc. While this modularity increases the functionality of a work machine, it can provide some challenges when switching between attachments of different sizes. For instance, an excavator may be designed with one bucket in mind, such that any motion of the excavator attachment will not inflict self-harm (e.g., the attachment will not make contact with another part of the excavator and damage it). However, when an attachment of a different size is used on the excavator, movement of the attachment to a certain position can inflict self-harm, (e.g., the attachment can contact and harm a portion of the excavator that is to be protected from contact). Further, some excavators can even inflict self-harm with a stock attachment that they were designed to work with. Therefore, some current systems detect when a movable element on the work machine is going to contact another portion of the machine and stops machine operation to avoid the contact. However, these types of systems often stop all machine movement or at least stop all movement of the movable element, in order to avoid the contact.

The present description thus proceeds with respect to a system that identifies the specific actuator(s) that is (are) moving the movable element toward the protected area of the machine and selectively limits movement of only the identified actuator(s) to avoid the contact.

Figure 1:
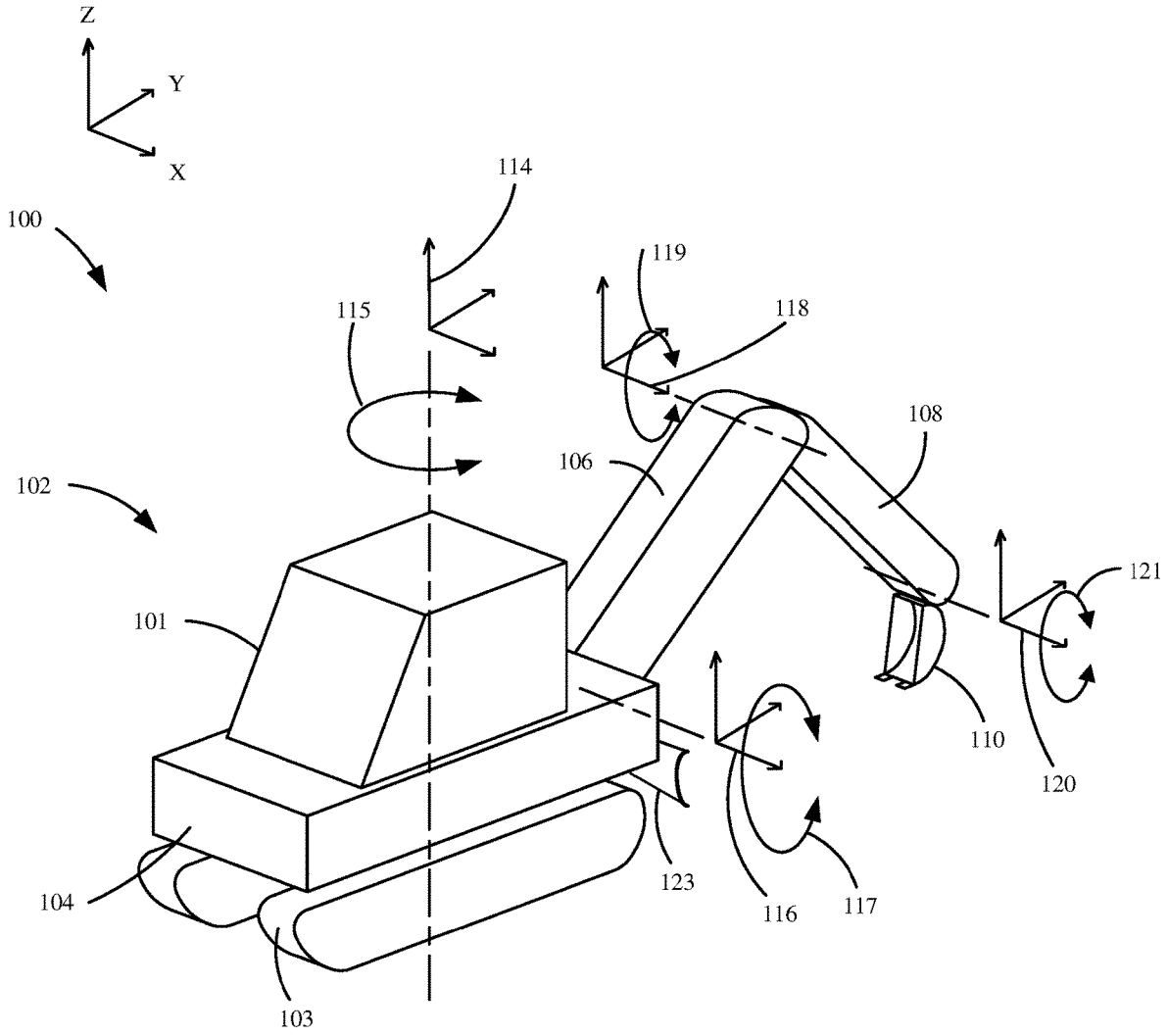
FIG. 1 is a perspective view of one example of a work machine.

FIG. 1 is a perspective view of one example of a work machine 102. Work machine 102 is operated either autonomously or by an operator located in operator compartment 101. Work machine 102 can include a variety of different controllable subsystems, some of which comprise movable elements and corresponding actuator(s) to actuate the movable elements. In the example shown in FIG. 1, the movable elements of the controllable subsystems include tracks 103, house 104, boom 106, stick (or arm) 108, blade 123, and attachment 110.

Each movable element is driven by one or more corresponding actuators (such as hydraulic cylinders, or other actuators). Tracks 103 are mounted to a lower frame of machine 102 and are driven by an engine or motors to guide and propel work machine 102 about a worksite 100. In other examples, tracks 103 can be replaced by wheels or other ground engaging elements.

Operator compartment 101 is coupled to the house 104 where internal components of work machine 102 are housed. Some of these internal components include an engine, transmission, hydraulic pumps, generators, etc. House 104 is supported by an upper frame and rotatably coupled relative to the lower frame of machine 102. House 104 is driven by an actuator to rotate about house axis 114 in the direction indicated by arrows 115.

Boom 106 is also rotatably coupled to the upper frame that supports house 104. Boom 106 rotates about boom axis 116 in the direction indicated by arrow 117. Stick or arm 108 is rotatably coupled to boom 106. Stick or arm 108 rotates about axis 118 in the direction indicated by arrow 119. Attachment 110 is shown as a bucket which is rotatably coupled to stick or arm 108. Attachment 110 rotates about attachment axis 120, in the direction indicated by arrow 121. As shown in FIG. 1, attachment 110 is a bucket, however, attachment 110 may be a wide variety of other attachments. For example, attachment 110 may be a grapple, an auger, a jackhammer, a trench digger, etc. FIG. 1 also shows that machine 102 includes a blade 123 that is movably coupled to the lower frame of machine 102. Blade 123 can be raised or lower relative to the lower frame of machine 102 by controlling an actuator.

In an example operation, an operator in operator compartment 102 can raise boom 106 by controlling an actuator to rotate boom 106 counterclockwise about axis 116. The operator can control actuators to rotate arm 108 clockwise about axis 118 and to rotate attachment 110 clockwise about axis 120. Moving these components in the way described may bring attachment 110 or boom 106 into contact with, and potentially damage, blade 123, or one of the tracks 103, or operator compartment 101, or another part of work machine 102. A system described in greater detail below can limit movement of the movable elements to inhibit one part of machine 102 from contacting a protected portion of work machine 102 (e.g., to inhibit mobile machine 102 from harming itself).

Figure 2:
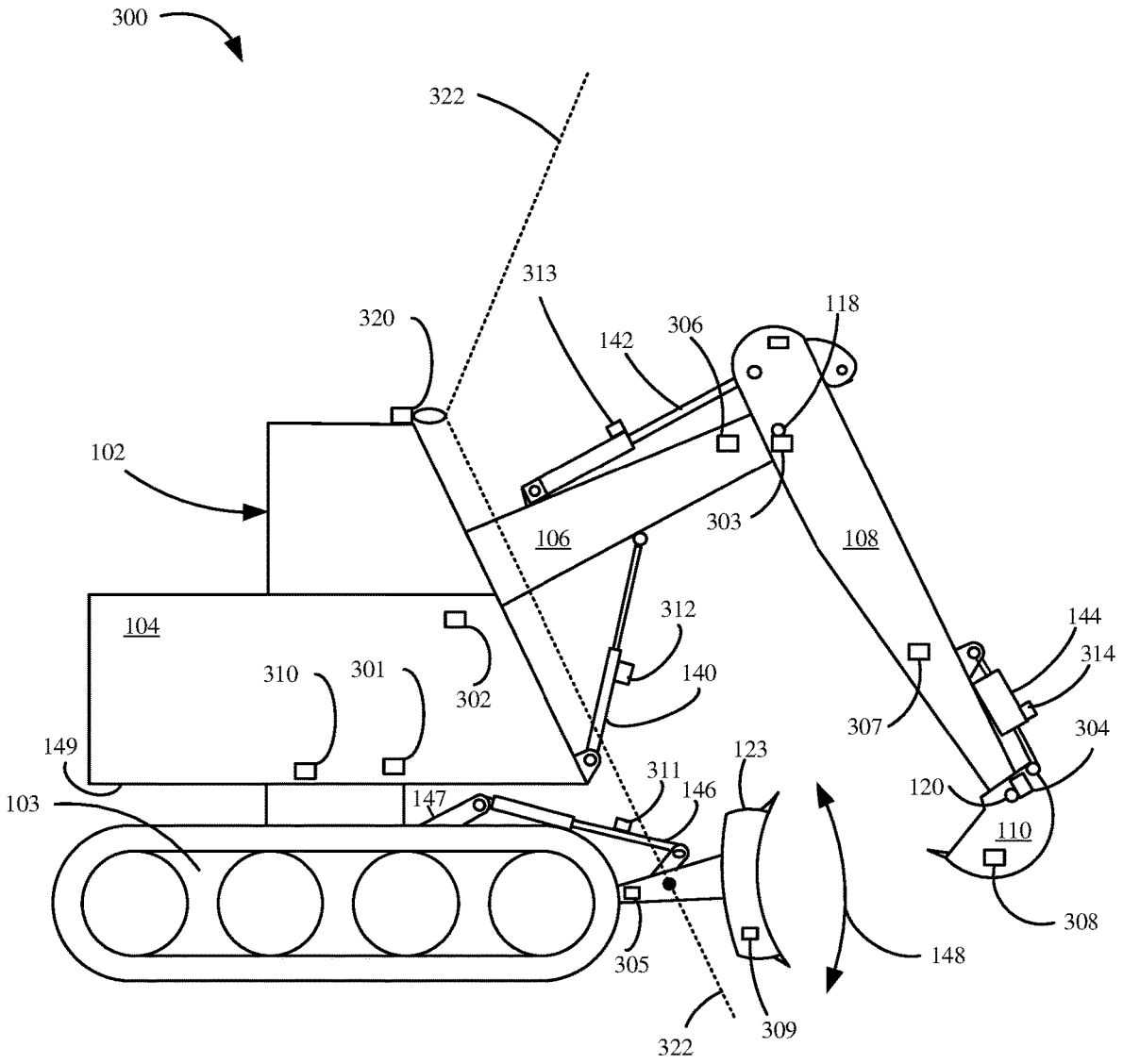
FIG. 2 is a side view of a work machine showing a plurality of sensors on the work machine.

FIG. 2 is a side view of another example of machine 102, in which similar items are similarly numbered to those shown in FIG. 1. FIG. 2 shows that actuator 140 can be extended to raise boom 106 and retracted to lower boom 106. Actuator 142 can be extended and retracted to pivot arm 108 about the axis 118. Actuator 144 can be extended and retracted to pivot attachment 110 about axis 120. FIG. 2 also shows that actuator 146 can be extended and retracted to lower and raise blade 123 generally in the direction indicated by arrow 148.

FIG. 2 also shows a set of sensors that can be deployed on machine 102. Sensor 301, for instance, can be coupled to the linkage between house 104 and the lower frame of machine 102 that supports tracks 103. Sensor 301 can generate a signal indicative of a rotary position of house 104 relative to the lower frame of machine 102. Thus, sensor 301 can be a potentiometer, an angle encoder, or another sensor that measures the rotary position of house 104 relative to the lower frame of machine 102.

Sensor 302 is illustratively coupled to the linkage between boom 106 the upper frame which supports house 104 to measure the position of boom 106 relative to house 104. For instance, sensor 302 can be a potentiometer or an angle encoder or another sensor that measures the angle of rotation of boom 106 about axis 116. Sensor 303 is illustratively coupled to the linkage between boom 106 and arm 108. Sensor 303 illustratively measures the position of arm 108 relative to boom 106. Sensor 304 is coupled to the linkage between arm 108 and attachment 110. Sensor 304 generates a signal indicative of the position of attachment 110 relative to arm 108. Similarly, sensor 305 is coupled to the linkage between blade 123 and the lower frame of machine 102 to measure the position of blade 123 relative to the lower frame 102.

In addition to, or instead of sensors 301-305, machine 102 can have sensors 306-310 which may be inertial measurement units (IMUs) that track inertia, acceleration, and rotation of the movable elements to which they are mounted. Then, using kinematic information (for example), the position or movement of the movable elements can be mathematically calculated if the IMU is placed in a known position on the movable element. In addition, or instead, machine 102 can also have sensors 311-314. Sensors 311-314 may be linear displacement transducers (LDTs), such as magnetic resistive transducers, Hall Effect sensors, etc., that are coupled to corresponding hydraulic actuators that drive movement of the different moveable elements. For example, sensor 311 is coupled to actuator 146 that actuates movement of blade 123 relative to the lower frame of machine 102. Sensor 311 generates a signal indicative of the extent to which cylinder 146 is extended and is thus indicative of the position of blade 123 relative to the lower frame of machine 102. Sensor 312 can similarly detect the extent to which cylinder 140 is extended. Sensor 313 can detect the extent to which cylinder 142 is extended, and sensor 314 can detect the extent to which cylinder 144 is extended. Based upon these detected measurements, and based on other kinematic information, the location of the movable elements driven by the corresponding actuators can be identified as well.

Similarly, FIG. 2 shows that machine 102 can have a sensor 320 which may be a camera (a stereo camera or mono camera), a laser-based sensor, a RADAR or LIDAR-based sensor, or a similar type of sensor along with its corresponding image processing logic or other sensor signal detection and processing logic. These types of sensors have a line of sight or field of view, an example of which is indicated by dashed lines 322 in FIG. 2. The field of view 322 of sensor 320 is a region in which sensor 320 can generate a signal indicative of a position of a component within its field of view defined by lines 322. For example, a camera can visually capture an image of blade 123. The processing logic can then identify the position of blade 123 in the image so the position of blade 123 relative to other moveable elements, such as relative to boom 106, attachment 110, etc. can be calculated. Sensor 320 and the processing logic can identify the location of other movable elements as well.

The present discussion proceeds with respect to a work machine 102 in which a collision avoidance system is used to limit the control of machine 102 so that a collision between a point-of-interest on the digging equipment on machine 102 (or another movable element of machine 102) and the blade 123 (or any other protected portion of work machine 102) is avoided. The actuators that are moving the point-of-interest toward a collision are identified and those actuators are selectively limited to avoid the collision.

Figure 3A:
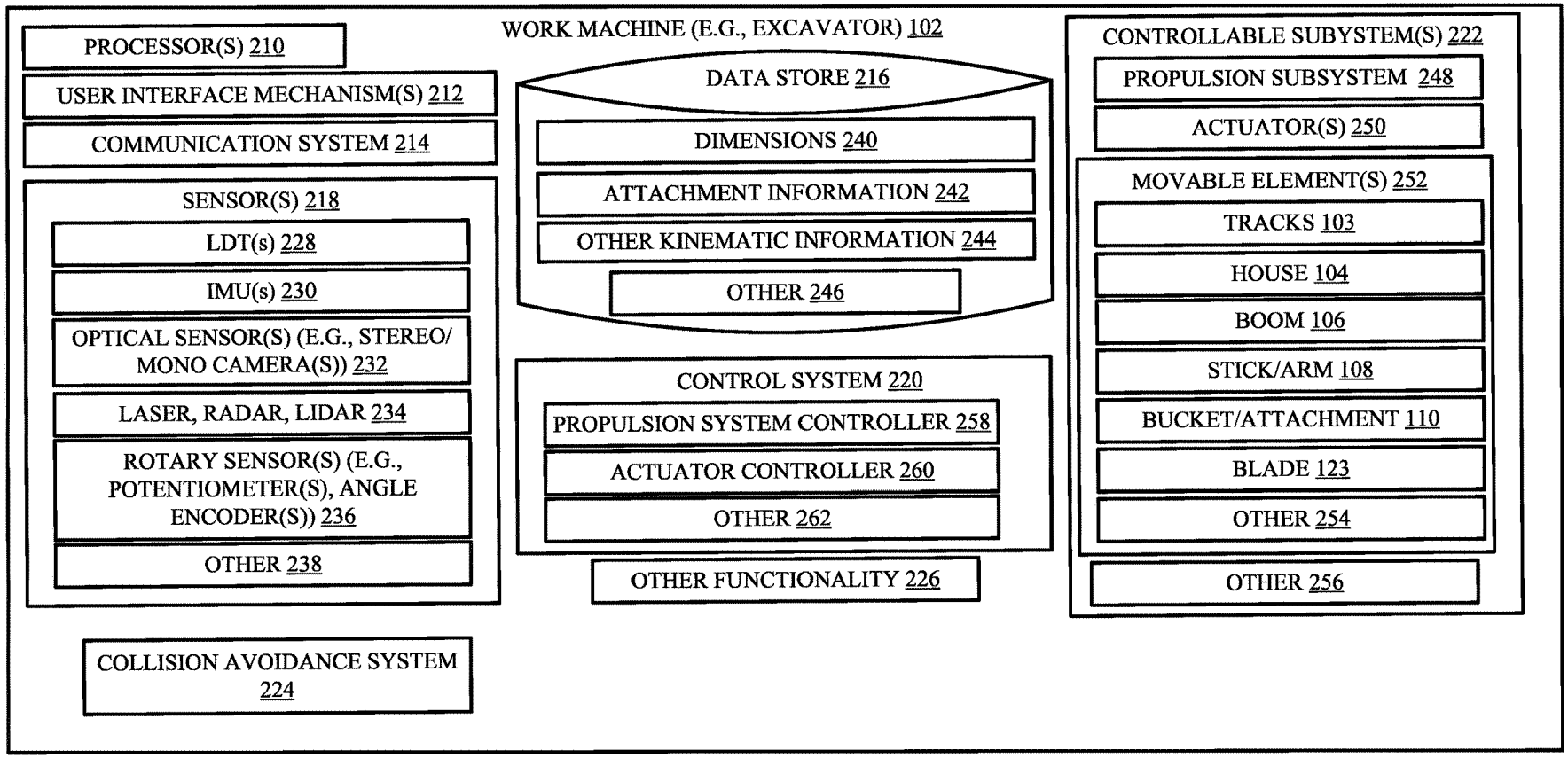
FIGS. 3A and 3B show block diagrams of one example of a work machine, in more detail.

FIG. 3A is a block diagram showing one example of such a work machine 102, in more detail. In the example shown in FIG. 3, work machine (e.g., excavator) 102 includes one or more processors 210, user interface mechanisms 212, communication system 214, data store 216, sensors 218, control system 220, controllable subsystem 222, collision avoidance system 224, and a wide variety of other machine functionality 226. Sensors 218 can include any or all of the sensors discussed above, including LDTs 228, IMUs 230, optical sensors (e.g., stereo/mono cameras) 232, laser, RADAR, LIDAR or other similar sensors 234, rotary sensors (e.g., potentiometers, angle encoders, etc.) 236, and other sensors 238. Sensors 218 can generate a signal indicative of the position (and/or velocity, acceleration, etc.) of the movable elements either in absolute coordinates or relative to one another and relative to other parts of machine 102.

Data store 216 can store dimensions 240, attachment information 242 (which may be an index of different attachments and their corresponding dimension and degree of freedom information), other kinematic information 244 which can be used to calculate the position of different moveable elements and points of interest on machine 102, and any of a wide variety of other information 246. Controllable subsystems 222 can include propulsion subsystem 248 which provides propulsion to machine 102, and a plurality of actuators 250 which can include the rotary actuator that drives rotary movement of house 104 relative to lower frame of machine 102, the various actuators 140, 142, 144, and 146 which drive movement of the movable elements on machine 102, and any of a wide variety of other actuators. Controllable subsystems 222 can include moveable elements 252 such as tracks 103, house 104, boom 106, stick or arm 108, bucket or other attachment 110, blade 123, and any of a variety of other movable elements 254. Controllable subsystems 222 can include other subsystems 256 as well. Control system 220 includes propulsion system controller 258, actuator controller 260, and other items 262.

Figure 3B:
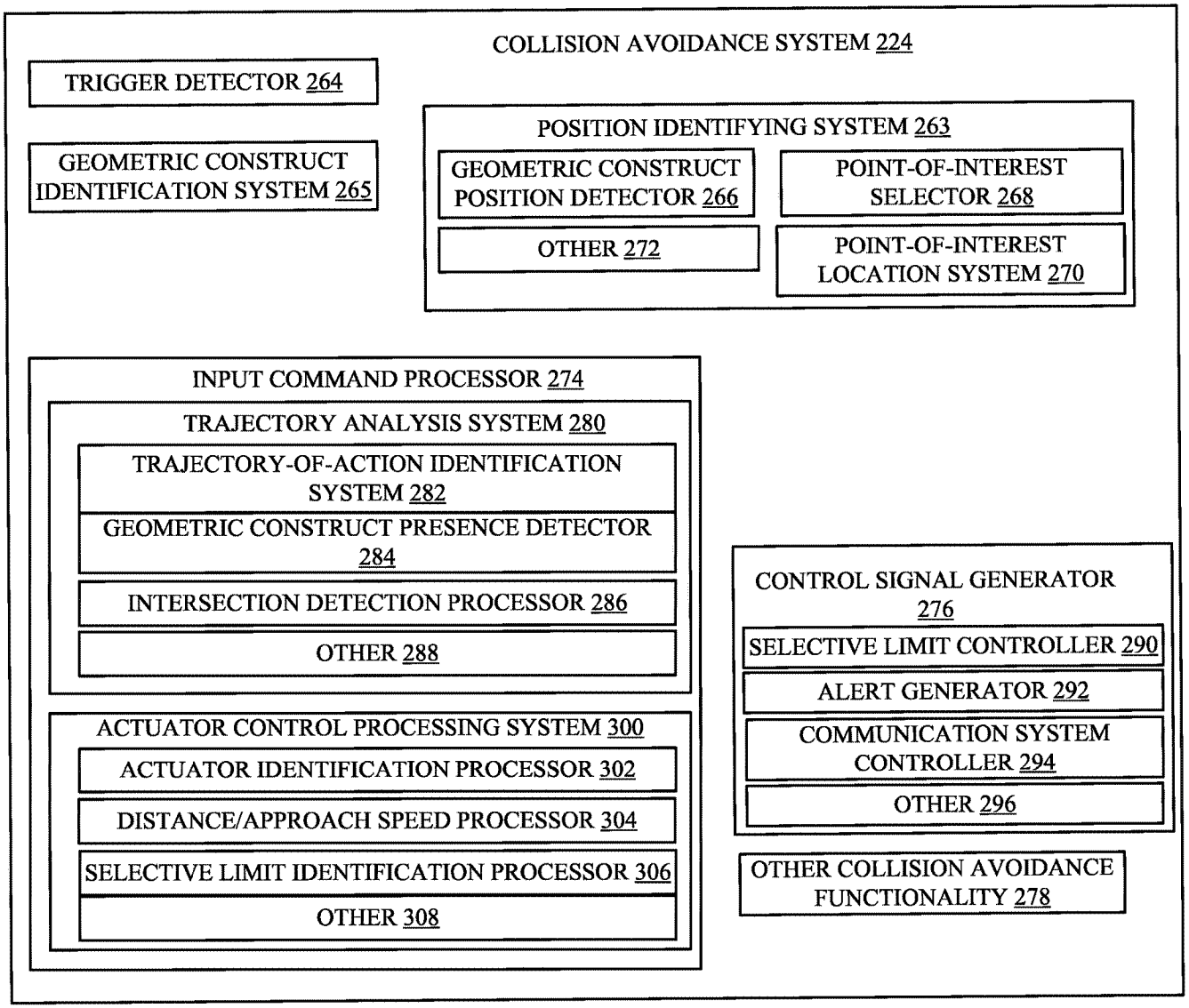

FIG. 3B is a block diagram showing one example of collision avoidance system 224 in more detail. Collision avoidance system 224 includes trigger detector 264, geometric construct identification system 265, position identifying system 263 (which includes geometric construct position detector 266, point-of-interest selector 268 point-of-interest location system 270, and other items 272), input command processor 274, control signal generator 276, and other collision avoidance functionality 278. Input command processor 274 can include trajectory analysis system 280, actuator control processing system 300, and other items 288. Trajectory analysis system 280 can include trajectory-of-action identification system 282, geometric construct presence detector 284, intersection detection processor 286, and other items 288. Actuator control processing system 300 can include actuator identification processor 302, distance/approach speed processor 304, selective limit identification processor 306, and other items 308. Control signal generator 276 can include selective limit controller 290, alert generator 292, communication system controller 294, and other items 296. Before describing the overall operation of work machine 102 in avoiding collisions between the digging equipment or other movable elements of work machine 102 and blade 123 or other protected areas of work machine 102, a description of some of the items in FIGS. 3A and 3B and their operation, will first be provided.

An operator can control and interact with machine 102 through user interface mechanisms 212. User interface mechanisms 212 can include a variety of different mechanisms including displays, touch screens, levers, pedals, steering wheel, joysticks, etc. Actuation of user interface mechanisms 212 can activate control system 220 to generate a control signal to control controllable subsystems 222. For instance, moving a lever or a joystick may cause actuator controller 260 to send a control signal to actuators 250 to rotate house 104 relative to the lower frame of machine 102, to raise or lower boom 108 and/or stick or arm 108, to manipulate bucket or other attachment 110, to raise or lower blade 123, etc. An operator input can also cause actuator controller 260 to generate a control signal to control propulsion system 248 to move and steer machine 102.

Communication system 214 illustratively facilitates communication of the items of work machine 102 with one another, and may also facilitate communication with other machines or other systems over a network. The network may be a wide area network, a local area network, a near field communication network, a Wi-Fi or Bluetooth network, a cellular communication network, or any of a wide variety of other networks or combinations of networks. Therefore, communication system 214 may be a controller area network (CAN) bus and bus controller, and other communication system functionality to communicate over other networks.

Collision avoidance system 224 may receive inputs from the various sensors 218 and obtain information from data store 216 and then generate an action signal to control the operation of machine 102 to avoid collisions between the movable elements of work machine 102 and protected areas or portions of work machine 102, to generate an alert message for an operator, etc. Thus, trigger detector 264 detects when collision avoidance system 224 is to operate to avoid such collisions. The trigger detector may detect various trigger criteria, such as an operator input engaging collision avoidance system 224, inputs indicating that the digging equipment is about to collide with a protected portion of work machine 102, or other trigger criteria.

Figure 4:
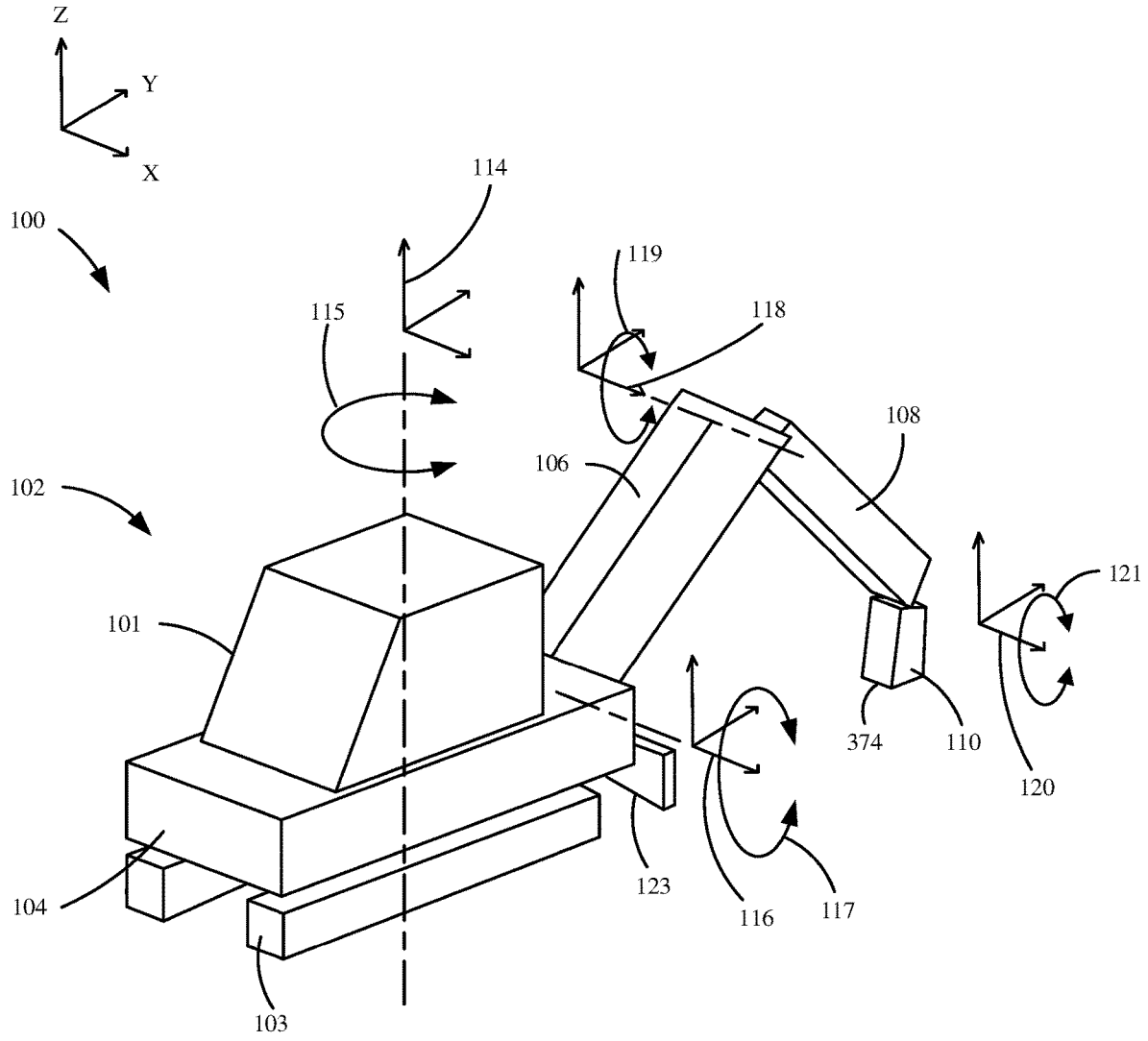
FIG. 4 is a perspective view of one example of a work machine with geometric structures generated for different portions of the work machine.

Once triggered, geometric construct identification system 265 obtains a set of vertices or other points defining a geometric construct representing one or more different protected areas on work machine 102. For instance, the set of vertices can be obtained from a solid model of machine 102 or downloaded from a remote server (such as a web site for the manufacturer of machine 102, etc.). The vertices allow geometric construct identification system 265 to generate a basic shape corresponding to each protected area of machine 102 as well as the movable elements of machine 102. FIG. 4, for instance, shows machine 102 with its elements replaced by basic shapes (or geometric constructs). The tracks 103, for example, are replaced by bounding boxes that each have a volume that encompasses a track. Blade 123 and attachment 110, as well as boom 106 and arm 108, are also replaced by geometric bounding boxes. The bounding boxes have a volume which encompass the corresponding elements of machine 102.

For example, trigonometry, kinematics, geometry, and one or more sensor signals and dimension information or attachment information 242 or other kinematic information 244 can be used to determine the position of a movable element and also to generate the bounding box or other geometric construct that encompasses or corresponds to the movable element and/or the protected portions of work machine 102. The dimensions 240 may be received as operator inputs or retrieved from another data store. For instance, the dimension information 240, attachment information 242, and other kinematic information 244 can be previously entered by an operator, preloaded by a machine manufacturer, or retrieved from a remote source.

Point-of-interest location system 270 in position identification system 263 then identifies a point-of-interest on a movable element of machine 102. Geometric construct position detector 266 identifies the positions of each of the protected areas or portions of machine 102 and the position of the point-of-interest. The positions of those elements can be identified in a coordinate system corresponding to machine 102, or in a global coordinate system, or in another way.

Once an input command is received, input command processor 274 processes that command to see whether execution of the command will result in a collision between any of the identified points of interest and any of the protected portions of machine 102. For instance, trajectory analysis system 280 uses trajectory-of-action identification system 282 to identify a trajectory along which the point-of-interest on the movable element will be moved if the input command is executed. Geometric construct presence detector 284 analyses points along the trajectory-of-action to determine whether a surface of any of the protected portions of machine 102 (the geometric constructs) lies in the same direction as the movement of the point-of-interest along the trajectory-of-action. If so, intersection detection processor 286 identifies where along the trajectory-of-interest the point-of-interest will intersect with the protected portion of machine 102 (the geometric construct).

Actuator control processor 300 then uses actuator identification processor 302 to identify which particular actuators 250 are responsible for moving the point-of-interest along the trajectory-of-action. Distance/approach speed processor 304 identifies how far away the point-of-interest is from the protected portion of machine 102 and the speed at which the point-of-interest is and will be approaching the protected portion of machine 102. Selective limit identification processor 306 then identifies a limit that is to be placed on the identified actuators 250, given the distance and approach speed of the point-of-interest, in order to avoid a collision (or contact) between the point-of-interest and the protected portion of machine 102 (the geometric construct) that lies along the trajectory-of-action.

Control signal generator 276 then generates control signals to selectively impose the limit on the identified actuators 250. By only imposing the limit on the actuators driving movement of the point-of-interest toward the collision, all other actuators remain fully functional.

Trajectory analysis system 280 can track the trajectory of the movable element relative to the protected portions of machine 102 through space, given the input from sensors 218 and given the data from data store 216, as well as the inputs from detectors 266 and 268 and systems 266 and 270. Intersection detection processor 286 can be an artificial neural network, a deep learning system, a machine learning system, or another system that takes, as inputs, the positions of the geometric constructs and points of interest as well as the commanded input, and generates an output indicative of whether the commanded input will result in a collision or will result in the point-of-interest coming within a threshold distance of a protected portion of machine 102.

In one example, where the commanded input would result in such a collision, then limit controller 290 generates an output to modify the commanded input so that actuator controller 262 is controlled to limit movement of only the identified actuator 250 to stop the point-of-interest short of the collision. Alert generator 292 can generate a control signal to control user interface mechanisms 212 to output an alert for the operator. The alert may indicate that the commanded input will result in a collision or will result in the point-of-interest coming within a threshold distance of a protected portion of machine 102. Communication system controller 294 can control communication system 214 to communicate the results of the information generated by collision avoidance system 224 to another machine, or to an external system. For instance, assume that the operator of machine 102 is an automated system. Assume further that the automated system is generating a high volume of command inputs which would result in the point-of-interest colliding with a protected portion of machine 102. In that case, this information may be useful in modifying the automated operator to avoid such operator inputs in the future or to otherwise control machine 102 in a more satisfactory way. Similarly, where alert generator 292 generates an operator alert, but the operator continues with the commanded input, resulting in a collision, this information may be useful as well.

Figure 5A:
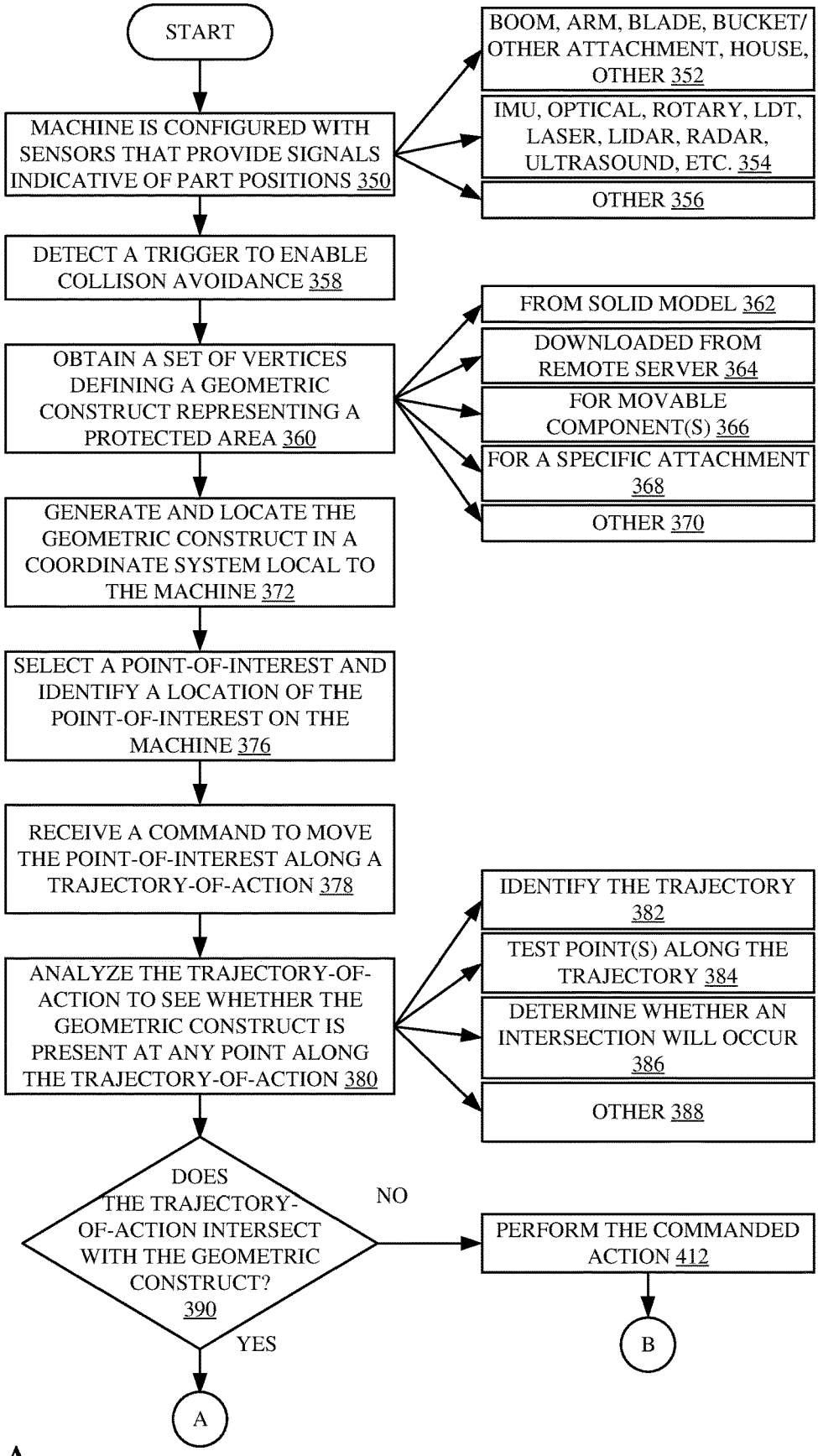
FIGS. 5A-5B (collectively referred to herein as FIG. 5) illustrate a flow diagram showing one example of the operation of the work machine in avoiding a collision between a point-of-interest and a protected part of the work machine.
Figure 5B:
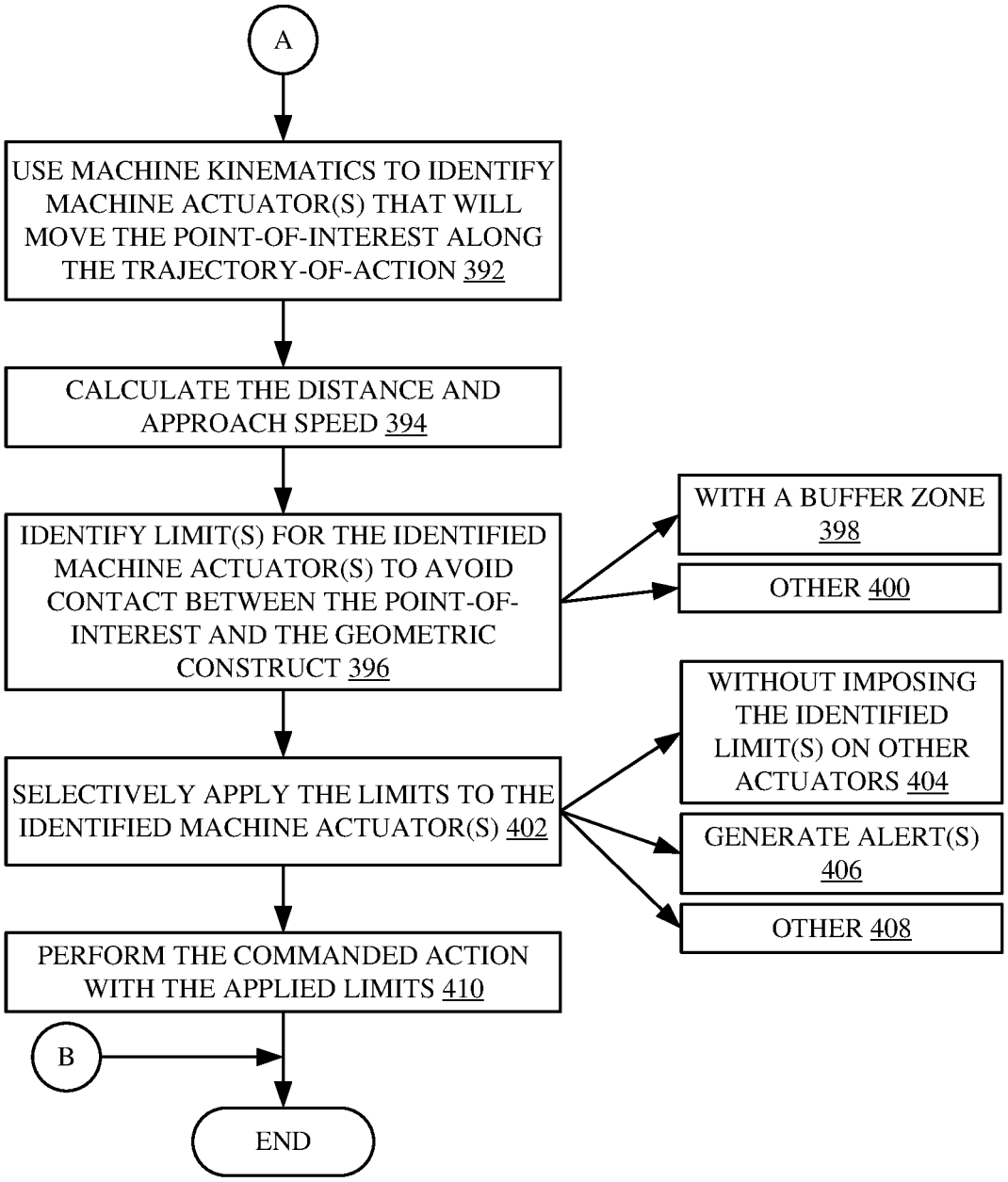

FIGS. 5A and 5B (collectively referred to herein as FIG. 5) show a flow diagram illustrating one example of the operation of collision avoidance system 224 in controlling machine 102 to avoid a collision between a point-of-interest on a movable element on machine 102 and any of the protected areas or protected portions of machine 102. It is first assumed that machine 102 is configured with sensors 218 that provide signals indicative of positions of the various movable elements and protected portions of machine 102. Having machine 102 configured in this way is indicated by block 350 in the flow diagram of FIG. 5. In one example, boom 106, arm 108, blade 123, bucket or other attachment or tool 110, and house 104 all have sensors that identify the position of those corresponding parts either in coordinates in a local or global coordinate system, relative to one another, or relative to a known position on machine 102, or elsewhere. Having such sensors is indicated by block 352 in the flow diagram of FIG. 5. As discussed above, the sensors 218 can be IMUs 230, optical sensors 232, rotary sensors 236, LDTs 228, LASER/RADAR/LIDAR/ultrasound based sensors 234, and/or other sensors 238. Having machine 102 configured with such sensors is indicated by block 354 in the flow diagram of FIG. 5. Machine 102 can be configured in other ways as well, as indicated by block 356.

At some point, trigger detector 264 detects a trigger that triggers collision avoidance system 224, as indicated by block 358 in the flow diagram of FIG. 5. The trigger can be an operator input, a sensed input, or other trigger criteria.

When collision avoidance system 224 is enabled, geometric construct identification system 264 obtains a set of vertices or other points defining one or more geometric constructs representing one or more different protected areas of machine 102. Obtaining vertices or other points defining such constructs is indicated by block 360 in the flow diagram of FIG. 5. The geometric constructs can be relatively simple shapes that replace more complex shapes. For example, and as discussed above with respect to FIG. 4, rectangular boxes are generated to replace tracks 103. Other rectangular boxes are generated to replace blade 123 as well as boom 106 and arm 108. An additional rectangular box is generated to replace bucket or other attachment 110. The geometric constructs illustratively include bounding boxes that encompass the volume occupied by the corresponding component. Therefore, for instance, the rectangular boxes that represent tracks 103 are large enough to encompass the volume that is occupied by tracks 103. Instead of generating the geometric constructs as boxes, the constructs could be generated as triangles, surfaces (2 dimensional surfaces that represent the peripheral surfaces of the item being represented), circles and/or other relatively simple geometric shapes.

The vertices or other points or information that are used to generate the geometric constructs can be obtained from a variety of different sources. For instance, those points or vertices can be obtained from dimensions 240, attachment information 242, or other kinematic information 244. The vertices or points can be obtained from a solid model of work machine 202, as indicated by block 262 and/or downloaded from a remote server, as indicated by block 364. The set of vertices or points can be obtained for all of the moveable components 366 as well as for specific attachments 368 and other protected areas or surfaces 370.

When the geometric constructs are generated, geometric construct position detector 266 then locates each of the geometric constructs in a coordinate system local to machine 102, as indicated by block 372. For instance, the signals from sensors 218 can be used to identify the position of the one or more points on machine 102 and then, using trigonometry, kinematic, and/or dimensional information, the positions of the geometric constructs can be calculated. In another example, a plurality of different sensors are placed at different locations on machine 102 so the locations of the different geometric constructs in the coordinate system local to machine 102 can be obtained more quickly or with less processing overhead. The geometric constructs and relative location information and/or other information can also be stored for later retrieval and use in avoiding collisions.

Point-of-interest selector 268 then selects a point-of-interest on a movable element. For instance, the point-of-interest may be the tip of the bucket, such as a point on the edge 374 of the geometric construct representing bucket 110 in FIG. 4. The point-of-interest may be contained in a line segment, or may be represented by a plurality of points on the line segment or in other ways. The location of the point-of-interest is then identified by point-of-interest location system 270. In a similar way that the geometric constructs are located in the coordinate system of machine 102, the selected point-of-interest can also be located using a sensor that provides an output from which that location can be calculated, or which directly indicates the location of the point-of-interest. Selecting a point-of-interest and identifying a location of the point-of-interest on the machine 102 is indicated by block 276 in the flow diagram of FIG. 5.

As one example, each of the sensors may generate a sensor signal indicative of the location of a corresponding piece of equipment on machine 102. Where each of the sensors provide a sensor signal indicating how far a corresponding actuator is extended, then by knowing the length of extension of each of the actuators and the geometry or dimensions of the corresponding piece of equipment, the location of the periphery of that piece of equipment can be known. For instance, by knowing the dimensions of bucket 110 and where the cylinder 144 attaches to bucket 110, then by knowing how far cylinder 144 is extended and where it attaches to arm 108, the position of the edge 374 of bucket 110 can be identified.

Input command processor 274 then receives an input command, such as through user interface mechanism 212, commanding movement of one of the movable elements of machine 102 (such as the boom 106, arm 108, attachment 110, house 104, etc.). The movable element that has been commanded to move illustratively has a point-of-interest on it. The input command will thus command that point-of-interest on the movable element to move along a trajectory-of-action. Receiving an input command to move a point-of-interest along a trajectory-of-action is indicated by block 378 in the flow diagram of FIG. 5.

Trajectory analysis system 280 then analyses the trajectory-of-action to see whether a geometric construct is present at any point along the trajectory-of-action, as indicated by block 380 in the flow diagram of FIG. 5. In one example, in order to analyze the trajectory-of-action, trajectory-of-action identification system 282 identifies the trajectory in space along which the point-of-interest will move given the input command, as indicated by block 382.

Geometric construct presence detector 284 then tests at various points along the identified trajectory to determine whether a surface of a protected portion or protected area (a surface of a geometric construct) of machine is present at that point on the trajectory, as indicated by block 384. Intersection detection processor 286 then detects whether an intersection (or collision) between the point-of-interest and the geometric construct will occur, based upon the presence of the geometric construct along the trajectory-of-action, as indicated by block 386. The trajectory-of-action can be analyzed in other ways as well, as indicated by block 388. Trajectory analysis system 280 generates an output indicative of whether, and where, the collision will occur.

If a collision is indicated by trajectory analysis system 280, as determined at block 390 in the flow diagram of FIG. 5, then actuator identification processor 302 uses machine kinematic information 244, to identify the particular machine actuator(s) 250 that will move the point-of-interest along the trajectory-of-action, as indicated by block 292 in the flow diagram of FIG. 5. Basically, actuator identification processor 302 identifies the specific actuator(s) which will need to be limited in order to avoid a collision between the point-of-interest and the geometric construct.

Distance/approach speed processor 304 then calculates the distance that the point-of-interest will need to travel along the trajectory-of-action and the speed at which the point-of-interest will approach the geometric construct. Calculating the distance and approach speed is indicated by block 394 in the flow diagram of FIG. 5.

Selective limit identification processor 306 then identifies the limits for the identified machine actuator(s) 250 that need to be selectively placed on those actuators to avoid contact between the point-of-interest and the geometric construct. Identifying such limits is indicated by block 396 in the flow diagram FIG. 5. For instance, based on the trajectory and approach speed, the identified actuator(s) 250 may need to begin braking or otherwise slowing down the approach speed at a particular point along the trajectory-of-action to avoid the collision. Thus, the limit on the identified actuator(s) may include a successive set of commands that slow down the actuator and eventually stop the actuator short of the collision. In another example, the limit may simply be a stopping point at which the actuator is to be turned off, in order to avoid the collision. In one example, the limit also considers a buffer zone 398 so that the point-of-interest will remain a threshold distance (identified by the buffer) away from the protected surface or protected portion of machine 102, that is represented by the geometric construct. The limits on the identified actuators can be identified or generated in other ways as well, as indicated by block 400 in the flow diagram of FIG. 5.

The limits are provided to control signal generator 276 where selective limit controller 290 selectively applies the limits only to the identified machine actuator(s) 250. Selectively applying the limits is indicated by block 402 in the flow diagram of FIG. 5. It will be noted that, by selectively applying the limits to only the identified actuators 250 that are responsible for moving the point-of-interest into a collision along the trajectory-of-action, other machine actuators and operations need not be limited or affected. This is in contrast to some prior systems which would lock down machine operation when a collision was imminent or sensed. Instead, the present system allows other machine operations to continue, even the operation of actuators that are moving the point-of-interest, but not those actuators which, when unlimited, are causing the collision.

As one example, assume that the command input that is being received is to raise boom 106 so that actuator 140 is being controlled to extend. In addition, assume that the input command is to extend actuator 142 as well as actuator 144. This may cause the point-of-interest (the edge of bucket 110) to move into contact with one of the tracks 103. The present system may identify that actuators 142 and 144 are the actuators that, if not limited, are actually going to cause the edge of bucket 110 to contact the protected portion of machine 102. Therefore, the present system may allow actuator 140 to continue to raise boom 106, but may impose limits on one or more of actuators 142 and 144 so that the edge of bucket 110 does not come into contact with the track 103 (or other protected portion of machine 102). In this way, the limits are selectively applied to only the actuators which are actually going to cause the contact, instead of applying limits to all actuators involved in the commanded movement of bucket 110.

This is just one example of how limits can be selectively applied to only identified actuators (which may be a subset of all of the actuators that are causing movement of the point-of-interest). Similarly, different limits may be applied to different actuators. One actuator may be severely limited or stopped while another actuator may be speed limited or limited in terms of position or both, but not stopped altogether, while still other actuators are not limited at all. Imposing the limit on the identified actuators without imposing the limits on other actuators is indicated by block 404 in the flow diagram of FIG. 5.

Alert generator 292 can also generate one or more alerts as indicated by block 406 and provide those alerts through user interface mechanisms 212 to the operator. Control signal generator 276 can generate other control signals (such as to communicate the limits and other information to other machines or other systems as indicated by block 408 in the flow diagram of FIG. 5. Performing the commanded action with the applied limits is indicated by block 410.

Returning to block 390 in FIG. 5, if the trajectory-of-action does not intersect with any geometric constructs, then the machine simply performs the commanded action, without the collision avoidance system 224 imposing limits on any actuators. Performing the commanded action is indicated by block 412 in the flow diagram of FIG. 5.

It can thus be seen that the present description proceeds with respect to a system that generates geometric constructs for different protected portions of machine 102 and locates those constructs in a coordinate system. The present system also identifies points of interest on movable elements which may come into contact with protected portions of machine 102. When an input command is received, a trajectory-of-action is identified and the system determines whether the trajectory-of-action intersects with a geometric construct corresponding to a protected portion of machine 102. If so, the specific actuators that are moving the point-of-interest along the trajectory-of-action are identified and limits are selectively placed on only those actuators to avoid the point-of-interest on machine 102 from contacting the protected portion of machine 102, without limiting actuation of other actuators.

The present discussion has mentioned processors and servers. In one example, the processors and servers include computer processors with associated memory and timing circuitry, not separately shown. The processors and servers are functional parts of the systems or devices to which they belong and are activated by, and facilitate the functionality of the other components or items in those systems.

Also, a number of user interface (UI) displays have been discussed. The UI displays can take a wide variety of different forms and can have a wide variety of different user actuatable input mechanisms disposed thereon. For instance, the user actuatable input mechanisms can be text boxes, check boxes, icons, links, drop-down menus, search boxes, etc. The mechanisms can also be actuated in a wide variety of different ways. For instance, the mechanisms can be actuated using a point and click device (such as a track ball or mouse). The mechanisms can be actuated using hardware buttons, switches, a joystick or keyboard, thumb switches or thumb pads, etc. The mechanisms can also be actuated using a virtual keyboard or other virtual actuators. In addition, where the screen on which the mechanisms are displayed is a touch sensitive screen, the mechanisms can be actuated using touch gestures. Also, where the device that displays them has speech recognition components, the mechanisms can be actuated using speech commands.

A number of data stores have also been discussed. It will be noted the data stores can each be broken into multiple data stores. All can be local to the systems accessing them, all can be remote, or some can be local while others are remote. All of these configurations are contemplated herein.

Also, the figures show a number of blocks with functionality ascribed to each block. It will be noted that fewer blocks can be used so the functionality is performed by fewer components. Also, more blocks can be used with the functionality distributed among more components.

It will be noted that the above discussion has described a variety of different systems, components, controllers, sensors, detectors, and/or logic. It will be appreciated that such systems, components, controllers, sensors, detectors, and/or logic can be comprised of hardware items (such as processors and associated memory, or other processing components, some of which are described below) that perform the functions associated with those systems, components, controllers, sensors, detectors, and/or logic. In addition, the systems, components, controllers, sensors, detectors, and/or logic can be comprised of software that is loaded into a memory and is subsequently executed by a processor or server, or other computing component, as described below. The systems, components, controllers, sensors, detectors, and/or logic can also be comprised of different combinations of hardware, software, firmware, etc., some examples of which are described below. These are only some examples of different structures that can be used to form the systems, components, controllers, sensors, detectors, and/or logic described above. Other structures can be used as well.

Figure 6:
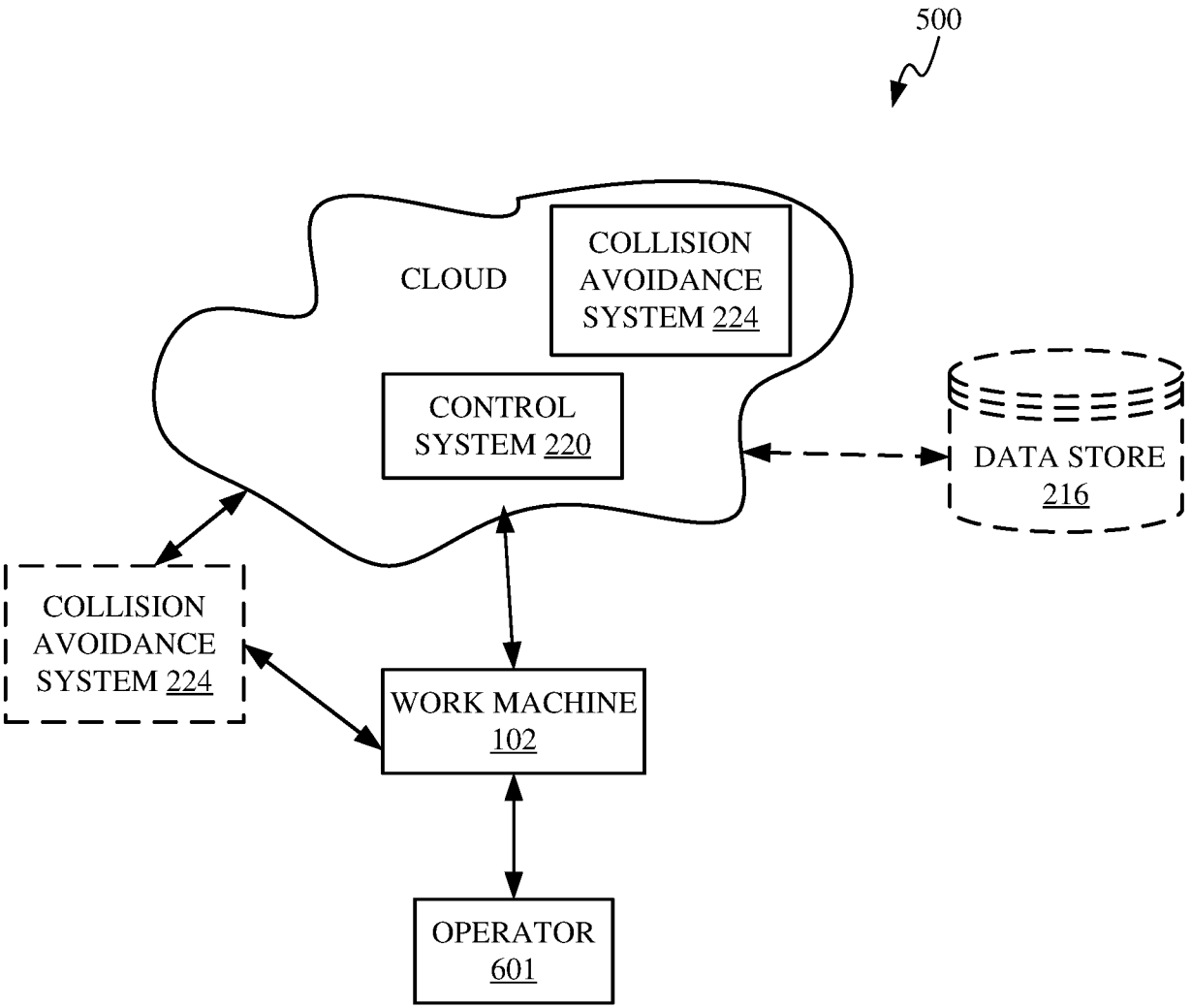
FIG. 6 is a block diagram showing one example of the work machine in a remote server environment.

FIG. 6 is a block diagram of machine 102, shown in FIG. 3 along with an operator 601. Also, FIG. 6 shows that machine 102 communicates with elements in a remote server architecture 500. In an example, remote server architecture 500 can provide computation, software, data access, and storage services that do not require end-user knowledge of the physical location or configuration of the system that delivers the services. In various examples, remote servers can deliver the services over a wide area network, such as the internet, using appropriate protocols. For instance, remote servers can deliver applications over a wide area network and they can be accessed through a web browser or any other computing component. Software or components shown in previous FIGS. as well as the corresponding data, can be stored on servers at a remote location. The computing resources in a remote server environment can be consolidated at a remote data center location or they can be dispersed. Remote server infrastructures can deliver services through shared data centers, even though they appear as a single point of access for the user. Thus, the components and functions described herein can be provided from a remote server at a remote location using a remote server architecture. Alternatively, they can be provided from a conventional server, or they can be installed on client devices directly, or in other ways.

In the example shown in FIG. 6, some items are similar to those shown in previous FIGS. and they are similarly numbered. FIG. 6 specifically shows that collision avoidance system 224 can be located at a remote server location 502. Therefore, machine 102 accesses those systems through remote server location 502.

FIG. 6 also depicts another example of a remote server architecture. FIG. 6 shows that it is also contemplated that some elements of previous FIGS are disposed at remote server location 502 while others are not. By way of example, data store 216 can be disposed at a location separate from location 502, and accessed through the remote server at location 502. Regardless of where the items are located, the items can be accessed directly by machine 102, through a network (either a wide area network or a local area network), the items can be hosted at a remote site by a service, or the items can be provided as a service, or accessed by a connection service that resides in a remote location. Also, the data can be stored in substantially any location and intermittently accessed by, or forwarded to, interested parties. For instance, physical carriers can be used instead of, or in addition to, electromagnetic wave carriers. In such an example, where cell coverage is poor or nonexistent, another mobile machine (such as a fuel truck) can have an automated information collection system. As the machine 102 comes close to the fuel truck for fueling, the system automatically collects the information from the machine 102 using any type of ad-hoc wireless connection. The collected information can then be forwarded to the main network as the fuel truck reaches a location where there is cellular coverage (or other wireless coverage). For instance, the fuel truck may enter a covered location when traveling to fuel other machines or when at a main fuel storage location. All of these architectures are contemplated herein. Further, the information can be stored on the machine 102 until the machine 102 enters a covered location. The machine 102, itself, can then send the information to the main network.

It will also be noted that the elements of previous FIGS., or portions of them, can be disposed on a wide variety of different devices. Some of those devices include servers, desktop computers, laptop computers, tablet computers, or other mobile devices, such as palm top computers, cell phones, smart phones, multimedia players, personal digital assistants, etc.

Figure 7:
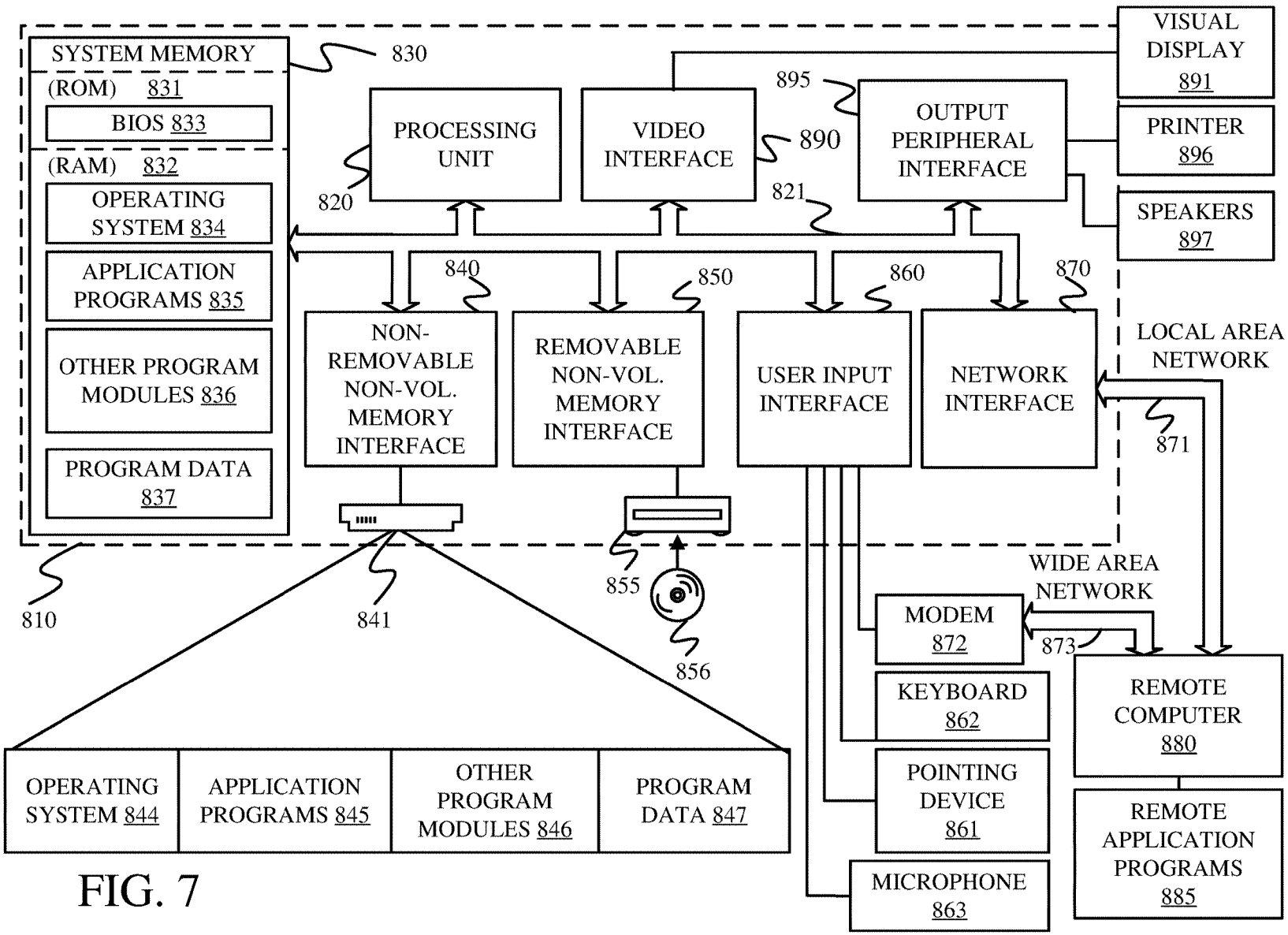
FIG. 7 is a block diagram of one example of a computing environment.

FIG. 7 is one example of a computing environment in which elements of previous FIGS., or parts of it, (for example) can be deployed. With reference to FIG. 7, an example system for implementing some embodiments includes a computing device in the form of a computer 810 programmed to operate as described above. Components of computer 810 may include, but are not limited to, a processing unit 820 (which can comprise processors or servers from previous FIGS.), a system memory 830, and a system bus 821 that couples various system components including the system memory to the processing unit 820. The system bus 821 may be any of several types of bus structures including a memory bus or memory controller, a peripheral bus, and a local bus using any of a variety of bus architectures. Memory and programs described with respect to previous FIGS. can be deployed in corresponding portions of FIG. 11.

Computer 810 typically includes a variety of computer readable media. Computer readable media can be any available media that can be accessed by computer 810 and includes both volatile and nonvolatile media, removable and non-removable media. By way of example, and not limitation, computer readable media may comprise computer storage media and communication media. Computer storage media is different from, and does not include, a modulated data signal or carrier wave. Computer storage media includes hardware storage media including both volatile and nonvolatile, removable and non-removable media implemented in any method or technology for storage of information such as computer readable instructions, data structures, program modules or other data. Computer storage media includes, but is not limited to, RAM, ROM, EEPROM, flash memory or other memory technology, CD-ROM, digital versatile disks (DVD) or other optical disk storage, magnetic cassettes, magnetic tape, magnetic disk storage or other magnetic storage devices, or any other medium which can be used to store the desired information and which can be accessed by computer 810. Communication media may embody computer readable instructions, data structures, program modules or other data in a transport mechanism and includes any information delivery media. The term "modulated data signal" means a signal that has one or more of its characteristics set or changed in such a manner as to encode information in the signal.

The system memory 830 includes computer storage media in the form of volatile and/or nonvolatile memory such as read only memory (ROM) 831 and random access memory (RAM) 832. A basic input/output system 833 (BIOS), containing the basic routines that help to transfer information between elements within computer 810, such as during start-up, is typically stored in ROM 831. RAM 832 typically contains data and/or program modules that are immediately accessible to and/or presently being operated on by processing unit 820. By way of example, and not limitation, FIG. 7 illustrates operating system 834, application programs 835, other program modules 836, and program data 837.

The computer 810 may also include other removable/non-removable volatile/nonvolatile computer storage media. By way of example only, FIG. 7 illustrates a hard disk drive 841 that reads from or writes to non-removable, nonvolatile magnetic media, an optical disk drive 855, and nonvolatile optical disk 856. The hard disk drive 841 is typically connected to the system bus 821 through a non-removable memory interface such as interface 840, and optical disk drive 855 are typically connected to the system bus 821 by a removable memory interface, such as interface 850.

Alternatively, or in addition, the functionality described herein can be performed, at least in part, by one or more hardware logic components. For example, and without limitation, illustrative types of hardware logic components that can be used include Field-programmable Gate Arrays (FPGAs), Application-specific Integrated Circuits (e.g., ASICs), Application-specific Standard Products (e.g., ASSPs), System-on-a-chip systems (SOCs), Complex Programmable Logic Devices (CPLDs), etc.

The drives and their associated computer storage media discussed above and illustrated in FIG. 7, provide storage of computer readable instructions, data structures, program modules and other data for the computer 810. In FIG. 7, for example, hard disk drive 841 is illustrated as storing operating system 844, application programs 845, other program modules 846, and program data 847. Note that these components can either be the same as or different from operating system 834, application programs 835, other program modules 836, and program data 837.

A user may enter commands and information into the computer 810 through input devices such as a keyboard 862, a microphone 863, and a pointing device 861, such as a mouse, trackball or touch pad. Other input devices (not shown) may include a joystick, game pad, satellite dish, scanner, or the like. These and other input devices are often connected to the processing unit 820 through a user input interface 860 that is coupled to the system bus, but may be connected by other interface and bus structures. A visual display 891 or other type of display device is also connected to the system bus 821 via an interface, such as a video interface 890. In addition to the monitor, computers may also include other peripheral output devices such as speakers 897 and printer 896, which may be connected through an output peripheral interface 895.

The computer 810 is operated in a networked environment using logical connections (such as a controller area network—CAN, local area network—LAN, or wide area network WAN) to one or more remote computers, such as a remote computer 880.

When used in a LAN networking environment, the computer 810 is connected to the LAN 871 through a network interface or adapter 870. When used in a WAN networking environment, the computer 810 typically includes a modem 872 or other means for establishing communications over the WAN 873, such as the Internet. In a networked environment, program modules may be stored in a remote memory storage device. FIG. 7 illustrates, for example, that remote application programs 885 can reside on remote computer 880.

It should also be noted that the different examples described herein can be combined in different ways. That is, parts of one or more examples can be combined with parts of one or more other examples. All of this is contemplated herein.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A method of controlling a work machine, comprising:

accessing a geometric construct corresponding to a protected portion of the work machine;

locating a point-of-interest on a movable element of the work machine relative to the geometric construct;

receiving a command to move the point-of-interest along a trajectory-of-action;

identifying a plurality of actuators that drive movement of the point-of-interest along the trajectory-of-action;

determining that the trajectory-of-action intersects with the geometric construct;

based on machine kinematic information and the trajectory-of-action, identifying a first limit for a first actuator in the plurality of actuators and a second limit, different than the first limit, for a second actuator in the plurality of actuators; and modifying the command to selectively limit movement of the point-of-interest relative to the trajectory-of-action, by applying the first limit to the first actuator and the second limit to the second actuator, to inhibit contact between the movable element and the protected portion of the work machine.

2. The method of claim 1 wherein the machine kinematic information is indicative of actuator actuations that move the movable element, the method comprising identifying, based on the machine kinematic information and the trajectory-of-action, a subset of actuators, that comprise some, but not all, of the plurality of actuators that can be limited to avoid contact between the point-of-interest and the protected portion of the work machine.

3. The method of claim 2, comprising:

selectively limiting movement of the subset of actuators to limit movement of the point-of-interest to maintain a threshold separation distance between the point-of-interest and the protected portion of the work machine.

4. The method of claim 1 wherein modifying the command to selectively limit movement comprises stopping actuation of the first actuator while the second actuator continues actuation to move the movable element.

5. The method of claim 1, wherein applying the second limit to the second actuator comprises not limiting movement of the second actuator.

6. The method of claim 5 wherein the command comprises a first actuator command for the first actuator and a second actuator command for the second actuator, and wherein selectively limiting movement comprises:

modifying the first actuator command but not the second actuator command.

7. The method of claim 1 and further comprising:

accessing a set of vertices corresponding to the protected portion of the work machine; and generating the geometric construct based on the set of vertices.

8. The method of claim 7 wherein accessing a set of vertices comprises:

accessing the set of vertices from a solid model of the protected portion of the work machine.

9. The method of claim 7 wherein accessing the set of vertices comprises:

downloading the set of vertices from a remote server.

10. The method of claim 1 wherein determining that the trajectory-of-action intersects with the geometric construct comprises:

locating the geometric construct in a coordinate system local to the work machine;

locating the trajectory-of-action in the coordinate system local to the work machine; and comparing the location of the geometric construct to the location of the trajectory-of-action to identify intersection of the trajectory-of-action with the geometric construct.

11. The method of claim 10 and further comprising:

identifying a distance of the point-of-interest from the protected portion of the work machine; and identifying a speed with which the point-of-interest approaches the protected portion of the work machine based on the command.

12. The method of claim 11, comprising:

selectively limiting movement of a subset of actuators, of the plurality of actuators, based on the distance and the speed with which the point-of-interest approaches the protected portion of the work machine.

13. A work machine, comprising:

a frame supporting a protected portion of the work machine;

a plurality of actuators configured to drive movement of a movable element relative to the frame;

a geometric construct position detector configured to identify a geometric construct corresponding to the protected portion of the work machine;

a point-of-interest location system configured to locate a point-of-interest on the movable element of the work machine relative to the geometric construct;

an input command processor configured to receive a command to move the point-of-interest along a trajectory-of-action and determine that the trajectory-of-action intersects with the geometric construct;

an actuator identification system configured to identify a first actuator, of the plurality of actuators, driving the movement of the point-of-interest along the trajectory-of-action and to identify a second actuator, of the plurality of actuators, driving the movement of the point-of-interest along the trajectory-of-action;

a selective limit identification processor configured to generate one or more limitation signals that define a first limit for the first actuator and a second limit, different than the first limit, for the second actuator; and an actuator controller configured to perform, based on the one or more limitation signals, the command to move the point-of-interest with the first limit applied to the first actuator and the second limit applied to the second actuator, to inhibit contact between the movable element and the protected portion of the work machine.

14. The work machine of claim 13 wherein the actuator identification system is configured to identify a subset of actuators, comprising some but not all of the plurality of actuators, that drive movement of the movable element along the trajectory-of-action, that can be limited to avoid contact between the point-of-interest and the protected portion of the work machine.

15. The work machine of claim 14 wherein the actuator identification system is configured to identify, as the subset of actuators, actuators driving movement of the point-of-interest along the trajectory-of-action and wherein the selective limit identification processor is configured to generate a plurality of limitation signals corresponding to the subset of actuators.

16. The work machine of claim 13, wherein the first limit comprises stopping actuation of the first actuator while the second actuator continues to actuate to move the movable element.

17. The work machine of claim 13 and further comprising:

a geometric construct identification system configured to access a set of vertices corresponding to the protected portion of the work machine and generate the geometric construct based on the set of vertices.

18. The work machine of claim 13 wherein the input command processor comprises:

a trajectory-of-action identification system configured to identify a location of the trajectory-of-action in a coordinate system local to the work machine;

a geometric construct position detector configured to identify a location of the geometric construct in the coordinate system local to the work machine; and an intersection detection processor configured to compare the location of the geometric construct to the location of the trajectory-of-action to identify intersection of the trajectory-of-action with the geometric construct.

19. A collision avoidance system, comprising:

a position detector configured to identify a geometric construct corresponding to a protected portion of a work machine;

a location system configured to locate a movable element of the work machine relative to the geometric construct;

a command processor configured to receive a command to move the movable element along a trajectory-of-action and determine whether the trajectory-of-action intersects with the geometric construct;

an actuator identifier configured to identify a plurality of actuators on the work machine that drive movement of the movable element along the trajectory; and a selective limit processor configured to:

based on machine kinematic information and the trajectory-of-action, identify a first limit for a first actuator in the plurality of actuators and a second limit, different than the first limit, for a second actuator in the plurality of actuators; and modify the command to selectively limit movement of the movable element relative to the trajectory-of-action, by applying the first limit to the first actuator and the second limit to the second actuator, to inhibit contact between the movable element and the protected portion of the work machine.

* * * * *